US006558469B2

(12) United States Patent
Swain

(10) Patent No.: US 6,558,469 B2
(45) Date of Patent: May 6, 2003

(54) COATING APPARATUS INCLUDING INSERT DEVICE

(75) Inventor: Eugene A. Swain, Webster, NY (US)

(73) Assignee: Xerox Corporation, Stamford, CT (US)

( * ) Notice: Subject to any disclaimer, the term of this patent is extended or adjusted under 35 U.S.C. 154(b) by 156 days.

(21) Appl. No.: 09/777,587

(22) Filed: Feb. 6, 2001

(65) Prior Publication Data

US 2002/0104480 A1 Aug. 8, 2002

(51) Int. Cl.[7] ..... B05D 1/28
(52) U.S. Cl. ..... 118/429; 118/400
(58) Field of Search ..... 118/429, 404, 118/407, 400, 500, 501

(56) References Cited

U.S. PATENT DOCUMENTS 2,399,400 A * 4/1946 Snelling
2,658,474 A * 11/1953 Jengbusch
2,874,732 A * 2/1959 Zepelovitch
5,693,372 A 12/1997 Mistrater et al. ..... 427/430.1
5,725,667 A 3/1998 Petropoulos et al. ..... 118/407

* cited by examiner

*Primary Examiner*—Brenda A. Lamb
(74) *Attorney, Agent, or Firm*—Zosan S. Soong

(57) ABSTRACT

An apparatus including: (a) a vessel for a solution having a bottom end and an open top end, and defining a vertical axis perpendicular to the bottom end; (b) an insert device having a bottom surface and a top surface and nested within the vessel, wherein the insert device defines a passageway dimensioned for a substrate which is parallel to the vertical axis and extending through the insert device, and wherein the insert device also defines at least one bypass channel extending through the insert to allow solution within the vessel to flow to the top surface of the insert device; and (c) an overflow container positioned adjacent the vessel to catch solution runoff from the top surface of the insert device.

17 Claims, 4 Drawing Sheets

FIG. 3
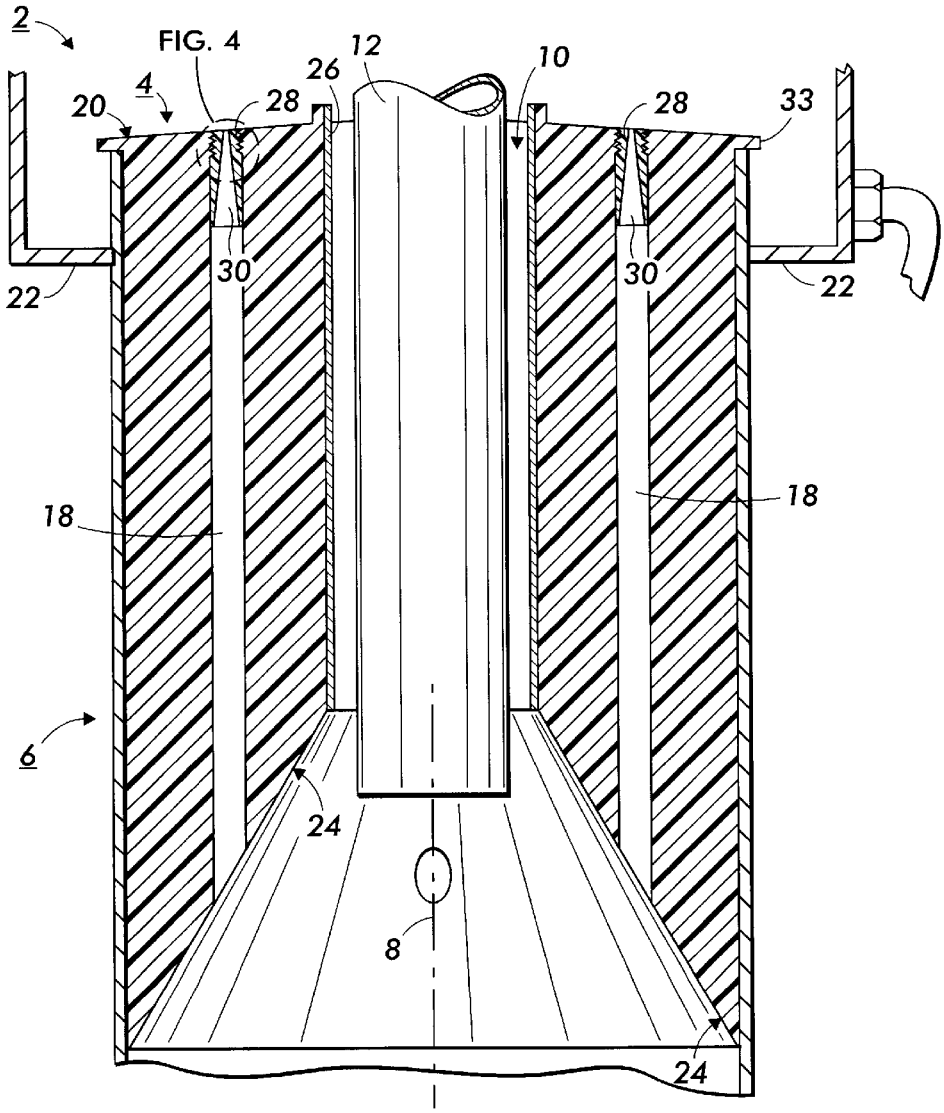
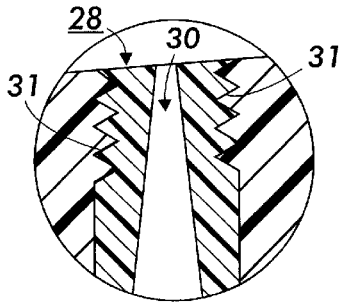
FIG. 4

COATING APPARATUS INCLUDING INSERT DEVICE

BACKGROUND OF THE INVENTION

Conventional coating systems such as those used for fabricating photoreceptors via dip coating can only accommodate substrates of a limited range of widths due to the importance of maintaining critical spacing between the outer dimension of the substrate and the inner dimension of the coating vessel. This critical distance generally must be maintained, especially when coating non-stable dispersions due to the occurrence of streaks and other associated coating defects. Thus, in conventional coating systems, substrates of different widths generally require their own vessels that are appropriately dimensioned. This limitation increases the cost of manufacturing since it may not be possible for the coating vessel to be re-used with a substrate of a different width.

Conventional coating systems are illustrated in Mistrater et al., U.S. Pat. No. 5,693,372 and Petropoulos et al., U.S. Pat. No. 5,725,667.

There is a need, addressed by the present invention, for a new coating system which minimizes or avoids the above discussed problem.

SUMMARY OF THE INVENTION

The present invention is accomplished in embodiments by providing a apparatus comprising:

(a) a vessel for a solution having a bottom end and an open top end, and defining a vertical axis perpendicular to the bottom end;

(b) an insert device having a bottom surface and a top surface and nested within the vessel, wherein the insert device defines a passageway dimensioned for a substrate which is parallel to the vertical axis and extending through the insert device, and wherein the insert device also defines at least one bypass channel extending through the insert to allow solution within the vessel to flow to the top surface of the insert device; and (c) an overflow container positioned adjacent the vessel to catch solution runoff from the top surface of the insert device.

There is also provided in embodiments an apparatus comprising:

(a) a vessel for a solution having a bottom end and an open top end, and defining a vertical axis perpendicular to the bottom end;

(b) an insert device having a top surface and a bottom surface, including:

(i) a first insert nested within the vessel, wherein the first insert defines a passageway extending through the first insert and parallel to the vertical axis; and (ii) a second insert nested within the passageway of the first insert, wherein the second insert defines a passageway dimensioned for a substrate which is parallel to the vertical axis and extending through the second insert, wherein there is at least one bypass channel extending through the insert device to allow solution within the vessel to flow to the top surface of the insert device; and (c) an overflow container positioned adjacent the vessel to catch solution runoff from the top surface of the insert device.

BRIEF DESCRIPTION OF THE DRAWINGS

Other aspects of the present invention will become apparent as the following description proceeds and upon reference to the Figures which represent preferred embodiments:

FIG. 3 depicts an elevational view in cross-section of a third embodiment of the present apparatus;

FIG. 4 depicts an elevational view in cross-section of a flow reduction insert useful in the present apparatus.

Unless otherwise noted, the same reference numeral in different Figures refers to the same or similar feature.

DETAILED DESCRIPTION

To accommodate substrates of different widths in the vessel, the number of inserts which collectively comprise the insert device can vary from one, two, three, or more.

Figure 1:
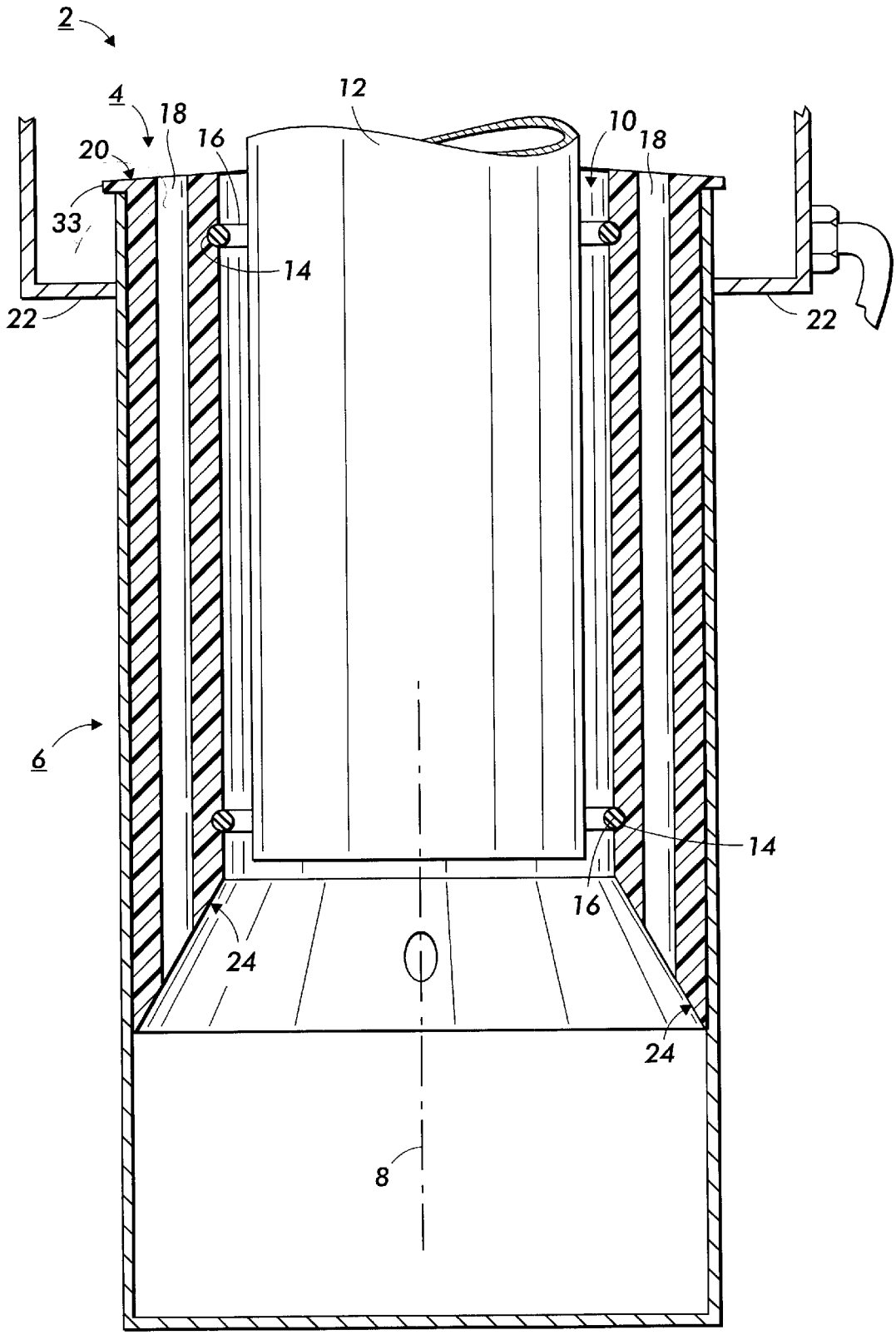
FIG. 1 depicts an elevational view in cross-section of a first embodiment of the present apparatus.

FIG. 1 depicts the present apparatus 2 where the insert device 4 is nested in the vessel 6 by pressing the insert device until seated on the larger flange 33 at the top of the insert device at surface 20 The vessel 6 has a bottom end and an open top end, wherein the vessel also defines a vertical axis 8 perpendicular to the bottom end. The passageway 10 extending through the insert device is dimensioned to accommodate a substrate 12 and optionally another insert. To facilitate the nesting of another insert within the passageway 10, the interior walls defining the passageway may optionally include one, two or more grooves 14 and an O-ring 16 in each groove.

At least one bypass channel 18 is present in the insert device 4 to permit solution within the vessel to flow to the top surface 20 of the insert device. The bypass channel or channels 18 may be parallel to the vertical axis 8 or may be at an angle. The number of bypass channels may range for example from 1 to 16, preferably from 6 to about 12. In embodiments, the number of bypass channels is at least 8. The bypass channel or channels may be of any suitable shape and size. For example, the bypass channel may be a single annularly shaped cavity encircling the passageway 10. In embodiments, there is a plurality of bypass channels which is arranged in a circle concentric around the passageway.

The top surface 20 of the insert device preferably is inclined in the direction that facilitates solution runoff into the overflow container 22 which is positioned adjacent the vessel. In embodiments, the top surface may be flat.

The bottom surface 24 of the insert device is preferably inclined in the direction that gradually constrains solution flow without creating turbulence.

Figure 2:
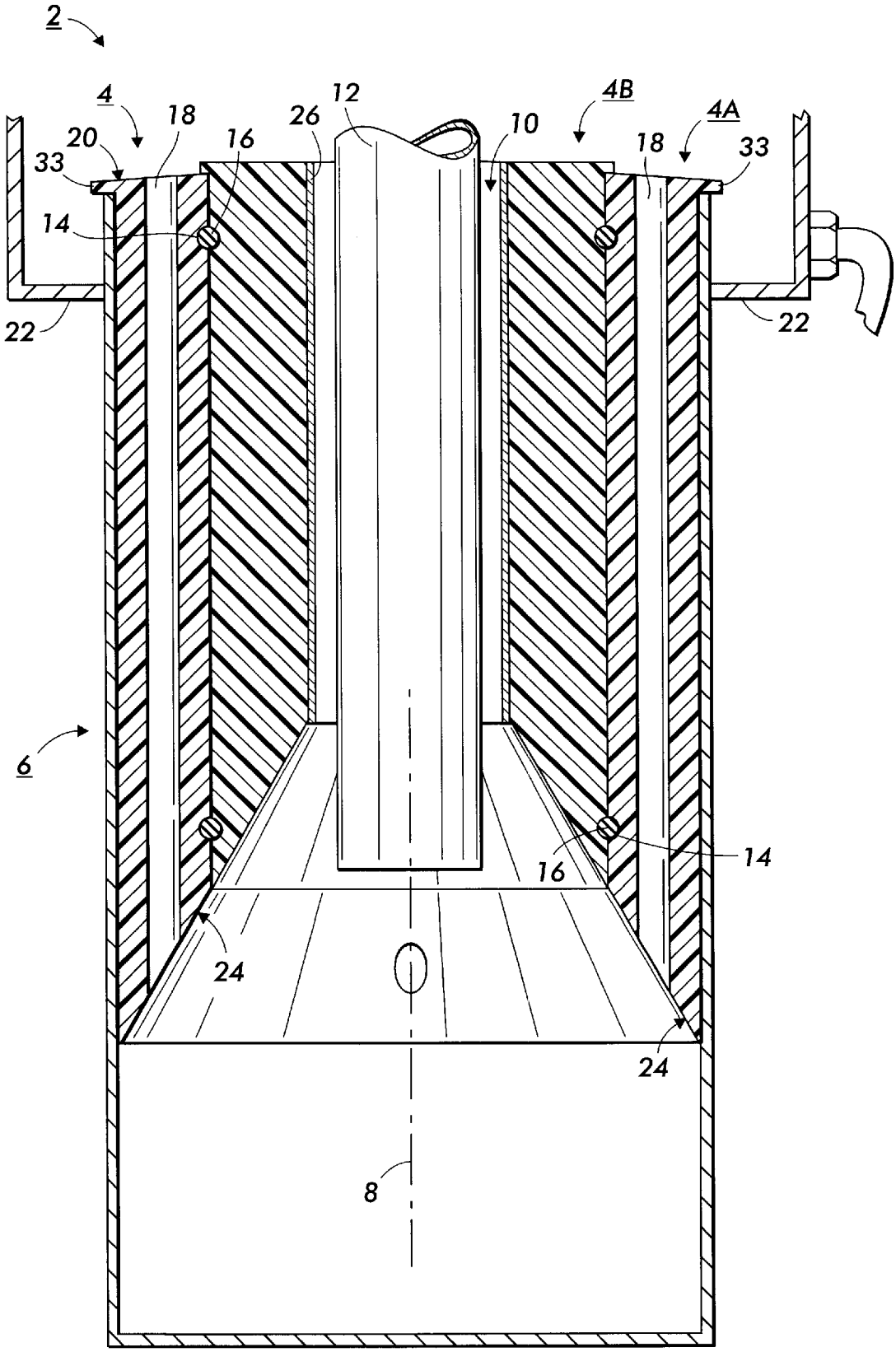
FIG. 2 depicts an elevational view in cross-section of a second embodiment of the present apparatus.

FIG. 2 depicts the insert device 4 as being composed of a first insert 4A and a nested second insert 4B. The second insert 4B defines a passageway 10 dimensioned to accommodate the substrate 12. Nesting of the second insert 4B into the passageway may be accomplished by for example the press fit technique. The second insert may be tapered to facilitate nesting of the second insert into the passageway. Optionally, a sleeve 26 may be nested by for example the press fit technique into the passageway 10 of the second insert 4B, wherein the sleeve extends above the top surface 20 of the insert device. The sleeve protects the insert device from damage resulting from contact with the substrate. The sleeve may be fabricated for instance from stainless steel, aluminum, copper, and glass.

The top surface 20 of the insert device defined by the first insert and the second insert preferably is inclined in the direction that facilitates solution runoff into the overflow container which is positioned adjacent the vessel. In embodiments, the top surface may be flat.

The bottom surface 24 of the insert device defined by the first insert and the second insert is preferably inclined in the direction that gradually constrains solution flow without creating turbulence.

In FIG. 2, the bypass channel or channels 18 are located in the first insert 4A. However, in other embodiments, the bypass channel or channels can be alternatively located in the second insert 4B. In embodiments involving a plurality of bypass channels, the bypass channels can be located in both the first insert and the second insert.

In embodiments of the present invention, there may be a third insert (not shown) nested in the second insert. This third insert may have a configuration similar to the second insert. The optional sleeve may then be nested in the passageway of the third insert, rather than nested in the second insert.

FIG. 3 depicts the insert device 4 where the bypass channels are positioned closer to the passageway as compared with the insert device of FIG. 1, where the bypass channels in FIG. 1 are positioned closer to the periphery of the insert device. As seen in FIGS. 3 and 4, a flow reduction insert 28 optionally may be present in each bypass channel. The flow reduction insert 28 defines a tapered channel 30 that reduces the flow rate of solution exiting to the top surface 20 of the insert device. The flow reduction insert and the portion of the bypass channel adjacent the top surface of the insert device optionally have threads 31 to facilitate coupling of the flow reduction insert with the bypass channel. In the event that flow of solution through passageway 10 is desired to be increased, then flow reduction inserts 28 are placed in one or more of the bypass channels which, in turn, causes more solution to flow through passageway 10.

Figure 5:
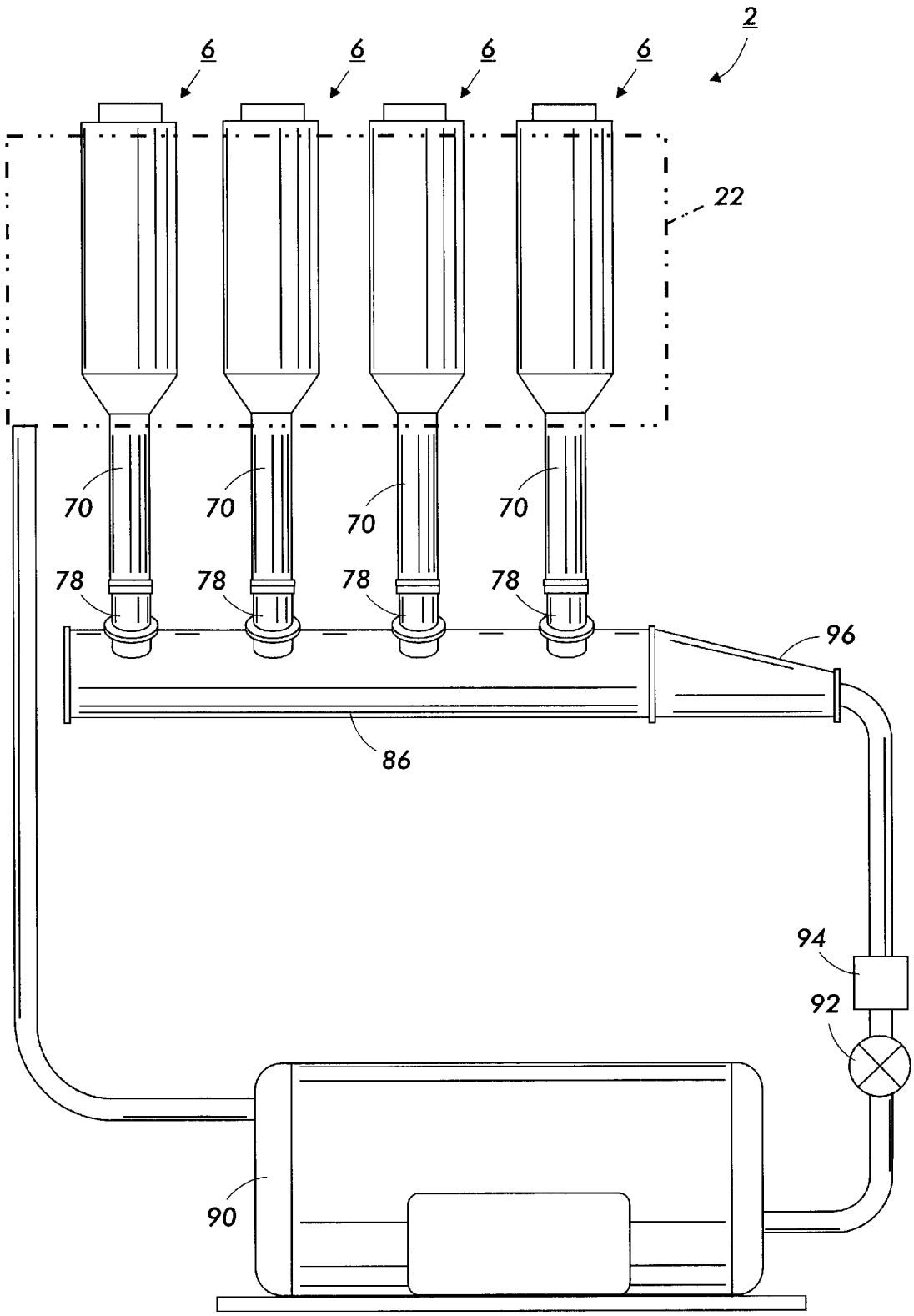
FIG. 5 depicts a schematic view of the present apparatus as a coating system.

The present apparatus may be used for example in a coating system such as a dip coating system. The apparatus 2 useful as an illustrative coating system is depicted in FIG. 5 where there is a plurality of vessels 6. A solution of a coating material is fed to these vessels through feed lines 70 which are connected through adaptor fittings 78 to feed manifold 86. When solution (not shown) overflows from the vessels into overflow container 22 (shown in phantom lines), the solution flows by gravity (a pump may be optionally employed) to reservoir 90. From reservoir 90, the solution is pumped by a pump 92 through a low pressure filter 94 into the tapered inlet 96 of manifold 86. The present apparatus transports and recirculates the solution while preferably isolating the solution from various energy inputs or losses to produce a consistently uniform and defect free coating. A conventional coating system is illustrated in U.S. Pat. No. 5,693,372, the disclosure of which is totally incorporated herein by reference.

Benefits of this invention are several and are mostly associated with cost savings based on manufacturing systems. This invention allows substrates of various widths to be processed within the same vessel and without changing solution supply volumes. Conventional practice generally utilizes a different sized vessel for each sized substrate, and therefore necessitates a wide range variable speed pump to supply the solution. These pumps are inefficient and of poor precision at the extremes of their speeds. The vessels are generally fabricated from polished stainless steel and are of high cost.

In order to change or regulate the flow of solution, flow reduction insert 28 can be inserted into bypass channel 18. Flow reduction inserts can be placed in all or only a portion of the bypass channels and in some cases it may be desirable to completely block the bypass channels. This can be accomplished by installing a flow reduction insert with no channel 30. The critical parameter relating to dip coating is the upward solution velocity along the side of the substrate during the dip coating cycle. This velocity is for example about 0.5 to about 1.5 cm/second for a pigmented solution with a viscosity of about 2 cps. If this flow is required to be increased, then reducing the size of some or all of the flow reduction inserts would be appropriate. Trial and error is the best way to accomplish adjustment.

The insert device may be made of the following materials: a plastic such as nylon, polyethylene, polypropylene, and polytetrafluoroethylene; and a metal such as stainless steel and aluminum.

The solution employed in the present invention can be for example a coating solution. Preferred coating solutions include those used in the fabrication of a photoreceptor such as a charge generating solution and a charge transport solution.

The substrate may be of any suitable configuration and composition. A preferred substrate is a hollow metal cylinder open at both ends such as that typically employed in a photoreceptor.

Other modifications of the present invention may occur to those skilled in the art based upon a reading of the present disclosure and these modifications are intended to be included within the scope of the present invention.

It is claimed:

1. An apparatus for coating a substrate comprising:

(a) a vessel for a solution having a bottom end and an open top end, and defining a vertical axis perpendicular to the bottom end;

(b) an insert device having a bottom surface and a top surface and nested within the vessel, wherein the insert device defines a passageway dimensioned for a substrate which is parallel to the vertical axis and extending through the insert device, wherein the passageway is dimensioned to allow a clearance between the passageway and the substrate for coating of the solution on the substrate, and wherein the insert device also defines at least one bypass channel extending through the insert to allow the solution within the vessel to flow through the bypass channel to the top surface of the insert device; and (c) an overflow container positioned adjacent the vessel to catch the solution runoff front the top surface of the insert device.

2. The apparatus of claim 1, wherein the at least one bypass channel is parallel to the vertical axis.

3. The apparatus of claim 1, wherein the at least one bypass channel includes a plurality of bypass channels which is arranged in a circle concentric around the passageway.

4. The apparatus of claim 1, wherein the at least one bypass channel includes 1 to 16 bypass channels.

5. The apparatus of claim 1, wherein the bottom surface of the insert device is inclined.

6. The apparatus of claim 1, wherein the top surface of the insert device is inclined.

7. The apparatus of claim 1, further comprising a sleeve nested in the passageway that extends above the top surface of the insert device.

8. The apparatus of claim 1, further comprising a flow reduction insert nested in the at least one bypass channel.

9. An apparatus for coating a substrate comprising:

(a) a vessel for a solution having a bottom end and an open top end, and defining a vertical axis perpendicular to the bottom end;

(b) an insert device having a top surface and a bottom surface, including:

(i) a first insert nested within the vessel, wherein the first insert defines a passageway extending through the first insert and parallel to the vertical axis; and (ii) a second insert nested within the passageway of the first insert, wherein the second insert defines a passageway dimensioned for a substrate which is parallel to the vertical axis and extending through the second insert wherein the passageway of the second insert is dimensioned to allow a clearance between the passageway of the second insert and the substrate for coating of the solution on the substrate, wherein there is at least one bypass channel extending through die insert device to allow the solution within the vessel to flow through the bypass channel to the top surface of the insert device; and (c) an overflow container positioned adjacent the vessel to catch the solution runoff from the top surface of the insert device.

10. The coating apparatus of claim 9, wherein the at least one liquid bypass channel is located in the first insert.

11. The apparatus of claim 9, wherein the at least one bypass channel is parallel to the vertical axis.

12. The apparatus of claim 9, wherein the at least one bypass channel includes a plurality of bypass channels which is arranged in a circle concentric around the passageway of the second insert.

13. The apparatus of claim 9, wherein the at least one bypass channel includes 1 to 16 bypass channels.

14. The apparatus of claim 9, wherein the bottom surface of the insert device is inclined.

15. The apparatus of claim 9, wherein the top surface of the insert device is inclined.

16. The apparatus of claim 9, further comprising a sleeve nested in the passageway of the second insert that extends above the top surface of the insert device.

17. The apparatus of claim 9, further comprising a flow reduction insert nested in the at least one bypass channel.

* * * * *